US012259214B2

(12) United States Patent
Ramirez

(10) Patent No.: US 12,259,214 B2
(45) Date of Patent: Mar. 25, 2025

(54) RIFLE COVER WITH SNAGLESS RETENTION

(71) Applicant: Ted Raymond Ramirez, Parker, CO (US)

(72) Inventor: Ted Raymond Ramirez, Parker, CO (US)

( * ) Notice: Subject to any disclaimer, the term of this patent is extended or adjusted under 35 U.S.C. 154(b) by 0 days.

(21) Appl. No.: 18/408,044

(22) Filed: Jan. 9, 2024

(65) Prior Publication Data

US 2024/0230277 A1 Jul. 11, 2024

Related U.S. Application Data

(60) Provisional application No. 63/479,538, filed on Jan. 11, 2023.

(51) Int. Cl.
*F41C 33/06* (2006.01)

(52) U.S. Cl.
CPC ..... *F41C 33/06* (2013.01)

(58) Field of Classification Search
CPC ..... F41C 33/06; F41C 33/00; F41C 33/02; F41C 33/0209; F41C 33/0236; F41C 33/0254; F41C 33/04
USPC ..... 42/96; 206/317
See application file for complete search history.

(56) References Cited

U.S. PATENT DOCUMENTS 4,754,498 A 7/1988 Stinemates
4,858,361 A * 8/1989 White ..... F41A 35/02 206/316.1
4,860,479 A * 8/1989 Easter ..... F41A 35/02 42/129
6,119,388 A * 9/2000 Jones ..... F41A 35/02 42/96
6,626,339 B2 * 9/2003 Gates ..... B62J 9/21 206/315.11
7,185,607 B1 3/2007 Pearson
7,360,648 B1 4/2008 Blaschke
8,327,572 B2 * 12/2012 Boggan ..... F41A 35/02 42/96
2006/0191184 A1 * 8/2006 Wisecup ..... F41A 35/02 428/17
2011/0041376 A1 * 2/2011 Brensinger ..... F41A 35/02 42/96
2013/0153450 A1 * 6/2013 Travis ..... F41C 33/06 206/317
2015/0285580 A1 * 10/2015 Utech ..... F41A 35/02 42/96

(Continued)

*Primary Examiner* — John Cooper
(74) *Attorney, Agent, or Firm* — Kyle W. Rost

(57) ABSTRACT

A cover for a long firearm has excess fabric in sidewalls of the cover body and has a long scope pocket attached at the top edge of the cover body with an open passage into the scope pocket. An elastic loop encircles the open passage to an exit point where opposite cord ends of the loop extend into a size adjuster where the ends are engaged in a selective cord lock that fixes the degree of applied tension in the loop. From the cord lock, the cord ends pass through different passages of a support panel separated by a divider. The cord ends then are received and united in a pull tab, where any interaction between the tab and the divider prevents backward extraction of the cord ends from the support panel. The elastic cord is supported against dangling below the cover body.

10 Claims, 2 Drawing Sheets

(56) References Cited

U.S. PATENT DOCUMENTS

| | | | | |
|---|---|---|---|---|
| 2015/0345888 | A1* | 12/2015 | Frazier | F41A 35/02 29/428 |
| 2017/0234651 | A1* | 8/2017 | Jones | F41G 1/383 42/143 |
| 2018/0202768 | A1* | 7/2018 | Bridgman, Jr. | F41G 1/383 |
| 2018/0347946 | A1* | 12/2018 | Bridgman, Jr. | F41G 1/383 |
| 2019/0086180 | A1* | 3/2019 | Kummer | F41A 35/02 |

* cited by examiner

RIFLE COVER WITH SNAGLESS RETENTION

FIELD OF THE INVENTION

The invention relates to article carriers for use with a rifle or shotgun. The carrier of the invention is a special receptacle for a weapon. The invention generally relates to small arms and a containment for carrying small arms, e.g. gun cases. The invention further relates to features of small arms, particularly to dust or weather protecting caps or covers.

BACKGROUND OF THE INVENTION

Gun cases find use in several distinct applications. One is as a transport and storage device. In this capacity, the gun case protects the firearm during handling, often by commercial handlers who may be loading or unloading the cased firearm to or from ground or air transport vehicles. Terms such as long gun, rifle, or firearm may be used interchangeably. Firearms such as rifles are cased in similarly long and unwieldy cases. Commercial handlers conducting loading and unloading operations may be particularly rough on a cargo item of unusual or unwieldy size, where harsh handling can be necessary to fit the item into a compact load in a cargo or luggage compartment. Even during the period of transport, accompanying luggage or other cargo bump and apply uneven pressures to the long case. With these and other transport hazards to be faced, it is evident that the case has to be strong and at least semi-rigid. It is also desirable that the gun case fully encloses the firearm, so that it cannot be viewed from outside the case. Firearms tend to be quite valuable as well as beautiful in appearance. Such complete enclosure is helpful to reduce any sort of temptation that viewing the firearm might inspire.

Yet, complete enclosure in a hard case is not useful in certain other applications. When handling the firearm in the field, such as when on a hunting expedition, it is desirable that the firearm be ready for use. Some users prefer to carry a rifle in their hands, where a hard case is nearly useless. However, a more accommodating type of case or cover is a soft case, configured to allow quick and reliable access to operate the rifle. The use of a cover or case in the field remains desirable to protect the firearm from outdoor hazards such as dirt and precipitation. Special modifications to a soft case can accommodate a variety of needs.

U.S. Pat. No. 7,185,607 to Pearson shows a soft case with a high degree of moisture-proofing, needed with black powder rifles. Extreme moisture-proofing is preserved by several features such as slack walls on the soft case allowing the user to operate the rifle through the sidewall; and a forward end over the muzzle formed of thin material that can be fired through without undue compromise of the shot. An integral scope cover can be raised from within the case, and such scope cover is made of clear plastic so that the user can view through a still covered scope.

U.S. Pat. No. 4,754,498 to Stinemates shows a soft case with a lower sleeve leading to the trigger area for receiving the user's hand and forearm. Quilted material can be used for the soft case and sleeve, offering fowl weather protection for both the rifle and the user's hand.

U.S. Pat. No. 7,360,648 to Blaschke shows a soft cover that holds a rifle between a stock end of the cover and a barrel end of the cover. Blaschke preferably is referred to as a cover because during use it may leave a significant portion of the firearm exposed to exterior weather. The possible exposure is at an intermediate body of the cover, which defines a significantly long open slot at the bottom for receiving the rifle while still allowing reception of the rifle stock and barrel into the corresponding stock end and barrel end of the cover. The body of the cover is formed of elastic material that might be stretched during insertion of the rifle and then would contract to urge together the stock end and barrel end to assist in retaining the rifle between the ends of the cover.

U.S. Pub. No. 2019/0086108 to Kummer shows another soft cover with a barrel portion at one end and a stock portion at the opposite end, and with an intermediate portion defining a size-adjustable slot or open bottom extending between the two end portions. The slot or open bottom is for receiving the rifle into or removing the rifle from the cover. The size-adjustment may be enabled by a channel formed at the edges of the open bottom slot and containing a gathering cord such as a drawstring or elastic cord that can be cinched to reduce opening size of the slot, or an elastic cord can be entirely enclosed within the channel to provide a fixed degree of stretching or contraction at the edge of the open bottom slot.

Kummer discloses a bulge in the top edge of the intermediate portion for accommodating a scope on the rifle. It is suggested that the cover might be configured to allow use of the scope while it remains covered. This usage is enabled by scope end openings defined in the cover, positioned to match the front and rear ends of the scope.

Viewed realistically, accommodating a long gun such as a rifle or shotgun in a cover presents a problem in the art due to sagging, dangling, or simply excess material of the cover surrounding the firearm. As one example, the basis of the problem arises in several factual features of covers, and the firearms that are carried in them. Fundamentally, a cover is sized to receive a limited range of firearm sizes and proportions. Long guns are not confined to any one set of proportions or dimensions. Rather, there are many variations in gun design, in part due to the presence of many different manufacturers in the marketplace and in part due to many different purposes for the long guns, which are satisfied by varying the design of the guns. In some cases, guns can be custom modified or fabricated, resulting in custom, one-of-a-kind sizing and proportioning. A topic seldom adequately considered in the art is what happens at the interface of long gun sizing versus cover sizing, other than suggestions of elasticity of fabric at the intermediate portion or the use of drawstrings to shorten the bottom slot and, hence, the distance between the barrel end and butt end of the cover. While it is an excellent practice to supply a narrow, form-fitting barrel portion of a cover, primarily suited to receive the firearm's barrel to the extent it extends in front of the gun's stock, this practice can lead to a snagging problem. The problem results from the length of this barrel portion of the cover not matching the length of the actual barrel of the firearm. If the muzzle end of the barrel bottoms-out in the barrel portion of the cover, the resulting final position of the long gun in the cover is shifted to the rear. Likewise, if the barrel is shorter, the length of the barrel portion of the cover may be only partially filled by the short barrel, resulting in the front end of the cover being hollow and forming a flopping nose at the front of the cover. These non-matching barrel insertion lengths are likely to present resulting irregular overall fit of the long gun in the cover, and very possibly the suggested elasticity of the fabric of the cover or use of a drawstring on the open lengthwise slot will not be satisfactory to correct the fit. The presence of loose or sagging fabric of the cover invites external snagging with features of the surrounding landscape. Excess fabric in the cover also can snag internally, slowing the process of extracting the firearm from the cover.

A similar snagging problem arises between optical scopes and a rifle cover. While the prior has suggested several ways to house scopes in a cover, the fit and snagging problem has not been solved. Of course, scopes come in a variety of lengths, which introduces an issue of fit based on relative lengths of the scope and of the scope reception area of the cover. Additionally, the mounting position of the scope on the firearm is variable to accommodate both the user's preferences and the size of the scope. Further, as previously described, the longitudinal position of a long gun in a cover cannot be fully anticipated, with the gun possibly being offset either forward or rearward from what might be considered to be the cover designer's intended position. Such longitudinal offset within the cover of the gun, itself, also introduces the same offset in the position of the scope. Accordingly, accommodating the resulting positional relationship between a scope, the firearm carrying the scope, and whatever provision may exist for the scope within the cover has a likelihood of leading to a misfit with the cover. There is opportunity for the scope to snag internally with the cover, and surplus cover material presents a further external snagging opportunity. A user may wish to keep his long gun within the cover until needed, such as until game is spotted. Snagging of any type reduces the quickness of readying the firearm for use, disturbs the user's focus on the sighted game, and may even result in enough disturbances to frighten away the game.

Users desire a snagless case or cover for their long gun or rifle not only when in the field but also during transport. Quick access to the rifle is, of course, important in any hurried or dangerous situation. A snagless design with an open bottom of a rifle cover makes for easy on and off when carrying the rifle over user's shoulder. A protective rifle and scope cover that does not impede the user's mobility is extremely useful in the field during inclement weather and also is helpful during transport. By law all major airlines require the use of a hard rifle case with lock. Once the user reaches a destination such as a national airport, the user may find it necessary to obtain local transport from a bush plane, horse or other local transport. Here, either the user or the transporter may desire a protective case to protect the firearm from damage. In all of these situations, the user benefits from a case or cover capable of protecting the rifle, and the benefit is enhanced when undesired events such as internal or external snagging are minimized or fully avoided.

To achieve the foregoing and other objects and in accordance with the purpose of the present invention, as embodied and broadly described herein, the method and apparatus of this invention may comprise the following.

SUMMARY OF THE INVENTION

Against the described background, it is therefore a general object of the invention to provide a longitudinally elongated firearm cover with an open backed, form fitting barrel pocket at the forward end of the cover for receiving the muzzle end of the firearm barrel, an open fronted butt pocket at the rear end of the cover for receiving the firearm butt, and an open bottomed, central body longitudinally extending between the barrel pocket and the butt pocket, the open bottom enabling passage of the firearm for insertion and removal of the firearm with respect to the interior of the cover, wherein the contour of the barrel pocket is wider proximately to the open back thereof for smooth reception of the muzzle there through and optional limited reception of the front end of the firearm forestock, where present, and where longitudinal room is present in the fit of the cover over a contained firearm.

Another object is to provide a longitudinally elongated rifle cover with an open backed, form fitting barrel pocket at the forward end of the cover for receiving the muzzle end of the rifle barrel, an open fronted butt pocket at the rear end of the cover for receiving the rifle butt, an open bottomed, central body of the cover longitudinally extending between the barrel pocket and the butt pocket, the open bottom extending longitudinally and enabling passage of the rifle for insertion and removal of the rifle with respect to the interior of the cover, a scope pocket forming a scope receiving cover at the top edge of the central body, extending over the majority of the length of the central body, the scope pocket forming a bottom opening into the central body over said majority length of the central body, and a snagless size adjuster at the interface of the scope pocket and the intermediate portion for conforming the size and position of the scope pocket, in use, to the size and position of a scope on a rifle contained in the cover.

According to the invention, a cover for a long firearm, such as a rifle or shotgun, provides snagless retention for the firearm. The cover is configured with a longitudinally elongated central body formed of flexible sheet material that is deployed as two opposite side panels that define between them a firearm reception space. The bottom of the central body between the two side panels is an open passage permitting reception of a firearm, when presented, into the reception space and extraction of the firearm from the reception space from below. A scope pocket is connected to the top edge of the central body and is configured with an open scope pocket bottom communicating with the firearm reception space inside the central body for reception of a scope on a presented firearm carrying such scope. A peripheral path defines the edge of the open scope pocket bottom and thereby defines the shape and location of the open scope pocket bottom. The peripheral path carries an elongated elastic cord, imparting elastic qualities to the peripheral path. The elastic cord has a central cord length following the peripheral path to an opening point in the path where the two opposite end lengths of the elastic cord exit the path. The end lengths can be pulled or released to variably adjust tension applied along the peripheral path, according to the degree of pulling tension they apply to the central cord length. A cord locking element receives the end cord lengths exiting the peripheral path and selectively locks the end cord lengths to preserve the applied degree of tension of the central cord length. An elongated support panel defines supporting passages receiving and supporting the end cord lengths from the cord locking element. A unifying tab receives and unites the end cord lengths from the support panel, serves as a pull tab of pulling the elastic cord ends, and serves as a sag preventer for maintaining the end cord lengths from dangling from the cover. The locking element and the support panel are attached to the central body near the top edge thereof to further support the end cord lengths from dangling from the cover.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 1:
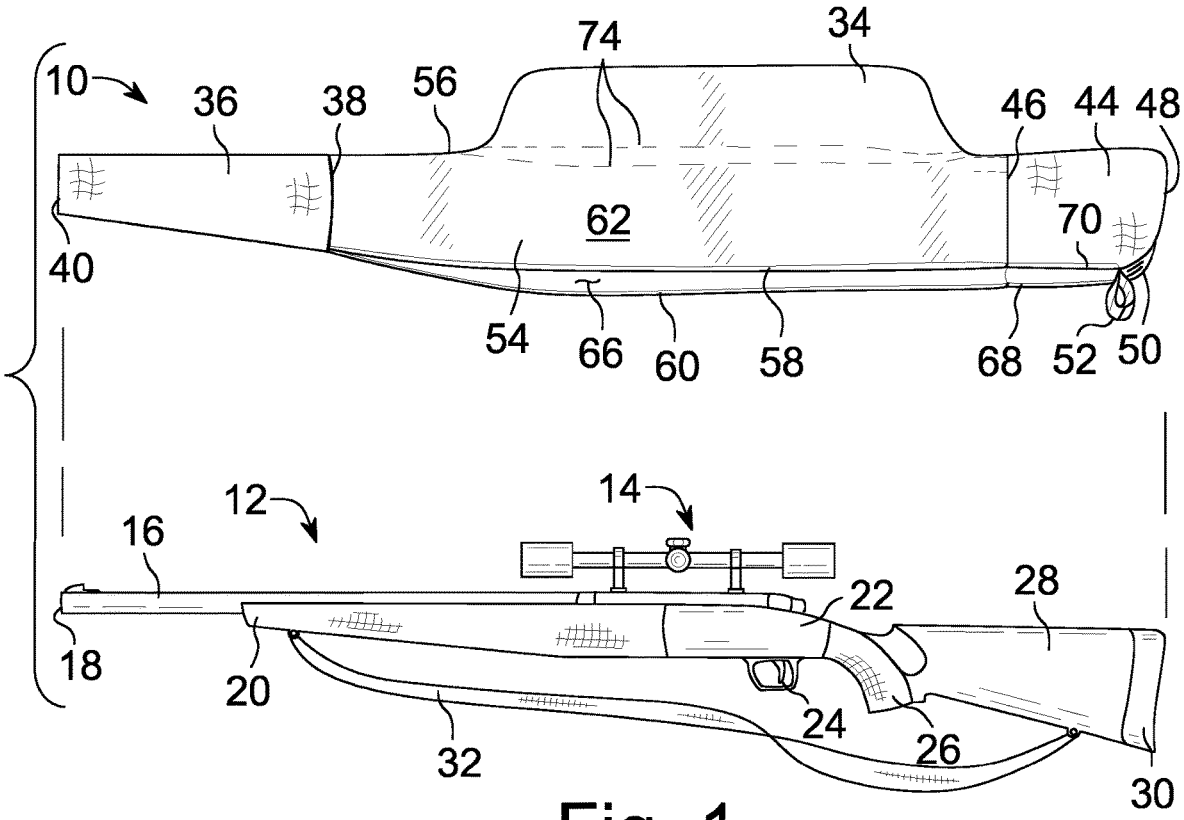
FIG. 1 is a side elevational view of a firearm cover of the invention and a representative firearm with scope, with the firearm cover shown in substantially flat position. The cover and firearm are oriented longitudinally on the horizontal between left and right ends of each.
Figure 2:
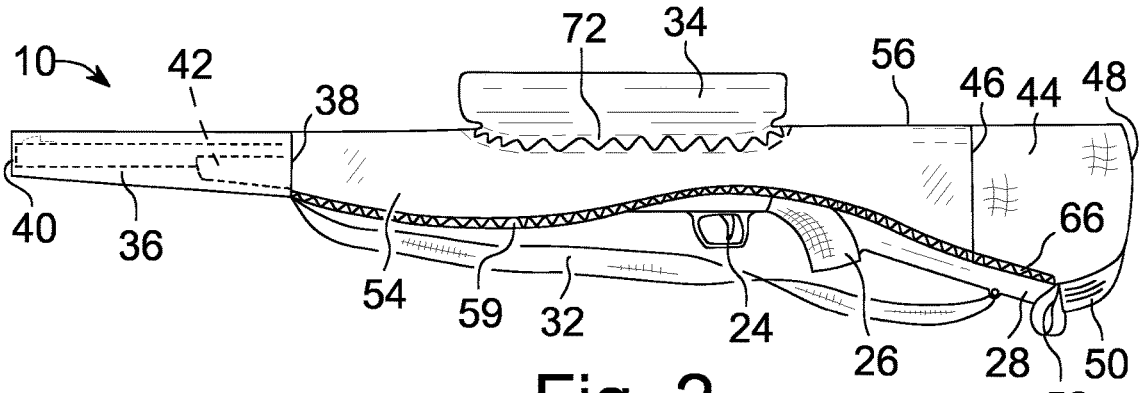
FIG. 2 is a side elevational view of the firearm cover of FIG. 1 with the representative firearm and scope inserted into the cover in a typical positional relationship, therefore showing the cover in a non-flat position, and showing in phantom both the front portion of the barrel and a nose of the forestock within the barrel pocket.

With reference to FIGS. 1 and 2, the invention is a longitudinally elongated cover 10 for a long gun such as a rifle, shotgun, or other long firearm. The term, "rifle" will be used as a representative term inclusive of any sort of long gun without limitation as to the exact variety of firearm that the cover might be applied to.

A rifle 12 with scope 14 is shown in the lower half of FIG. 1 with the longitudinal dimension extending horizontally between left and right ends. The following standard terminology applies to a rifle's parts, with similar or equivalent parts being found in most other varieties of long firearm:

A barrel 16 is the longitudinal tube shown at the left end of rifle 12 and serves to pass the bullet in the longitudinal direction of the barrel.

A muzzle 18 is the front end of the barrel, at the left end of the rifle 12, where the bullet leaves the barrel.

A forestock 20 is at the left end of the base, below the barrel at the center or right portion of the barrel.

A receiver 22 is a housing behind the forestock and barrel, housing operating components of the internal action, which may include a hammer, bolt or breechblock, firing pin, and extractor.

A trigger and trigger guard 24 is mounted on the bottom of the receiver and operates components of the internal action that fire a bullet.

A grip or pistol grip 26 is located rearward of the receiver and is a downwardly extending handle to be held by the user's hand at an at least a partial vertical angle, similar to the handle of a conventional pistol. The grip generally is held by the user's hand that operates the trigger.

A stock 28 is a rearwardly extending brace or rest, behind the grip, for bracing the rifle against the user's shoulder when firing.

A butt or recoil pad 30 is the rear end of a stock, positioned to contact the user's shoulder, often also defined by a recoil pad.

A sling 32 is a carrying strap that often extends from a sling stud on the stock to a sling stud on the forestock.

The cover 10 with scope pocket 34 is shown in the upper half of FIG. 1 and in FIG. 2. The cover is longitudinally elongated and has a central body with opposite side panels, a top edge, and bottom edges, generally defining an interior space that, in use, receives the body of a contained rifle. A longitudinal front end of the central body is connected to a first special purpose pocket that during use receives a barrel of the contained rifle. A longitudinal rear end of the central body is connected to a second special purpose pocket that during use receives the butt end of the stock of the contained rifle. The scope pocket is connected to the central body at the top edge and during use receives the scope of the contained rifle. The pockets are open to the interior of the central body. The bottom edges are bottoms of the opposite side panels and define an open, longitudinal slit between them that, in use, allows insertion of the rifle to be contained in the central body and pockets.

The barrel pocket 36 is located at the forward end of the cover. It has an open back end 38 for receiving the front or barrel end of the contained rifle. The length is selectable, although a length of about twelve inches is preferred so that a substantial portion of the rifle barrel 16, in front of the forestock 20, is received in the barrel pocket. The width or diameter of the barrel pocket is sufficient that the muzzle end 18 of a typically sized rifle barrel can be received at the muzzle end 40 of the barrel pocket. A muzzle end diameter of about one and one-quarter inches is preferred and is considered to be a form fitting portion of the barrel pocket. The barrel pocket has a rearward flare in diameter. At the open rear end of the barrel pocket, the diameter is larger than at the muzzle end, creating a snagless feature. With a diameter at the rear end 38 of the barrel pocket of about two inches, the rear end of the barrel pocket may be able to further receive a larger diameter portion of the rifle than the rifle barrel, alone, which may prove helpful where such larger diameter portion is present and suitably positioned. The anticipated larger diameter object is the front end of the rifle's forestock 20, as illustrated by the phantom forestock end 42 shown in FIG. 2, when the length of the rifle barrel in front of the forestock is short enough to allow this. In this circumstance, admitting the forward end of the forestock 20 into the barrel pocket 36 can prevent undesired rearward offset of the rifle's desired fitting position in the cover. When the rifle's muzzle is not grounded against the muzzle end of the barrel pocket, the entry of the forestock 20 into the flared end of the barrel pocket 36 also extends the muzzle end 18 of the rifle barrel further into the barrel pocket 36, which can prevent or reduce any sagging of the nose at the muzzle end 40 of the barrel pocket 36.

The butt pocket 44 is located at the rear end of the cover 10. It has an open front end 46 for receiving the rear or stock end of a carried rifle. The sizing of the butt pocket should be sufficient that the butt end of typically sized rifle stock can be received in the fill depth of the butt pocket, at a back wall 48 of the butt pocket 46. A preferred length of a butt pocket is about six inches, and a preferred height is about five inches. In the interest of snug fit, these dimensions are roughly minimums and can be varied as desired. Expanded dimensions of an inch or two may be desired for receiving correspondingly larger stocks. A rifle stock has both a significant height and a significant thickness, so the butt pocket is constructed to have a back wall 48 imparting a width to better accommodate the wide shape of rifle butt 30 of a stock 28. The back wall 48 may have a width of about two and one-quarter inches, which is suitable for entry of a typical butt of a rifle stock 28. In addition, the butt pocket defines a hooking feature by a bottom hook wall 50 extending at least slightly forward from the lower end of the back wall 48. For example, the hook wall may angle downwardly and forwardly at forty-five degrees. As a result, the hook wall extends forward by only a fraction of the length of the butt pocket, such as about one-sixth, equating to about two inches in overall length with only one inch in forward disposition, considering the preferred dimensions of the butt pocket.

The hook wall 50 has utility in establishing easy insertion and easy withdrawal of the rifle into and out of the cover. Initially the rifle is inserted into the cover by inserting the barrel 16 into the barrel pocket. Second, the butt end of the rifle stock has to be inserted into the butt pocket 44, but when the cover snugly fits the rife, this latter insertion may be tight due to comparative lengths of the rifle and the cover. The hook wall 50 is the solution to rapidly applying the cover to the rifle. This wall is short, allowing the user to easily hook it over the butt end of the rifle stock. As a further aid, the hook wall carries a finger loop 52 at its lower, forward end, which enables the user to apply pulling force to pull back the lower the leading edge of the hook wall to ease full entry into the butt pocket of the butt end of the stock. The finger loop is equally helpful in pulling down and back on the leading edge of the hook wall as a first step in extracting the rifle from the cover.

Figure 3:
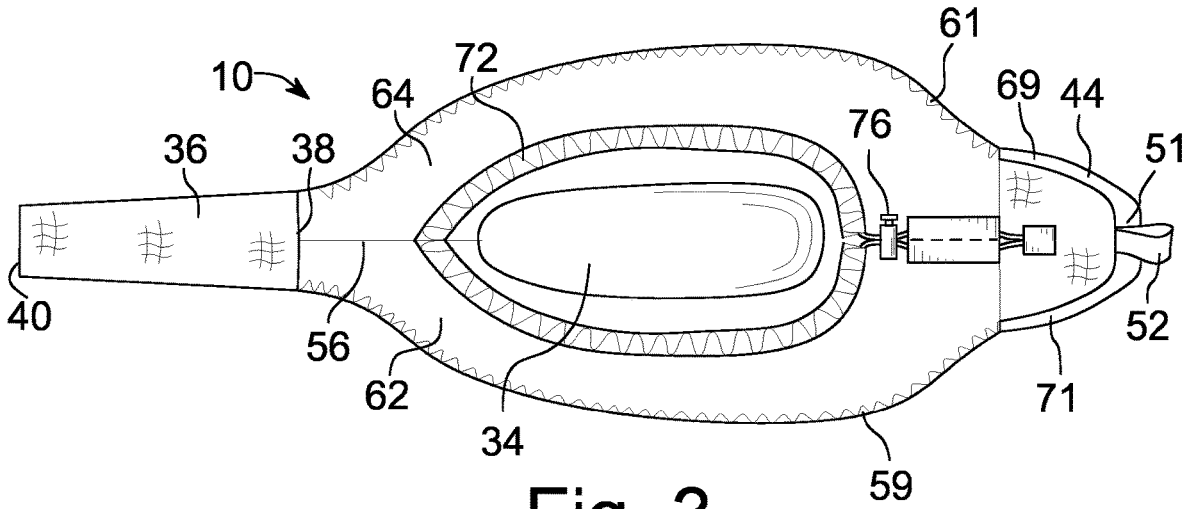
FIG. 3 is a bottom view of the firearm cover of FIG. 1, shown in substantially flat position with the firearm cover stretched open at a bottom opening of the intermediate portion and butt pocket to show internal structure, especially of the scope pocket and snagless size adjuster for configuring the scope pocket.

The central body 54 of the cover 10 is intermediate the opposite end pockets and the opposite side panels. It is located between the open rear end 38 of the barrel pocket 36 and the open front 46 of butt pocket 44. The central body 54 may be formed from a single sheet of fabric folded at a center fold line that correspond, in one embodiment, to a top edge of the scope pocket 34, or in another embodiment, to a top edge 56 of a central body 54. The fabric sheet defines the resulting left and right side panels 62, 64 from the fabric respectively on opposite sides of the center fold line. The left and right side panels 62, 64 are substantially mirror images of one another. Thus, the side panel 62 shown in FIGS. 1 and 3 is a left side panel. The substantially identical opposite side panel 64, best shown in FIG. 3, is a right side panel. Between the two side panels, cover 10 has a central reception area for a rifle or other long gun. The two side panels are shaped by trimming as needed, which may include partially splitting and reshaping the single fabric body at the top fold line at top edge 56 and rejoining the trimmed edges at a seam along top edge 56. The central body 54 is connected into the overall cover 10 by a fore end seam at the periphery of the open end 38 of the barrel pocket. The central body 54 also is connected at an aft end seam to the periphery of the open front end 46 of the butt pocket. The bottom edge 58 of the left panel and the bottom edge 60 of the right panel are not joined over their major longitudinal extent. Instead, the left side bottom edge 58 and the right side right side bottom edge 60 form an open slit 66 between them, extending longitudinally over the majority of their lengths. Open slit 66 is a major longitudinal entry or exit slit for passage of the rifle 12 to or from a rifle reception space in the cover 10. At the butt pocket, the slit 66 extends rearwardly beyond open front edge 46, resulting in the butt pocket defining an extension of slit 66. The butt has a right side panel with a free lower edge 68 and a left side panel with a free lower edge 70. The free lower edges 68, 70 come together at a lateral cross edge corresponding to the position where finger loop 52 is attached, or equivalently at the lower, forward edge of the hook wall 50. Accordingly, in one embodiment, the slit 66 extends from a front at an intersection with open face 38 of the barrel pocket to a rear at hook wall 50.

In another embodiment, the two sides of slit 66 are the continuous right edges 60, 68 and the continuous left edges 58, 70. Some or all of these edges are adapted to contraction by adding an elastic element to each, with the elastic element shown as a zig zag pattern at in some or all edges in selected views. Edges that are at least optional candidates for elastic modification are renumbered. Contracted edge 58 is renumbered as 59, contracted edge 60 is renumbered as 61, optionally modified edge 68 is renumbered as 69, and optionally modified edge 70 is renumbered as 71. The optionally modified cross edge is numbered as element 51 in FIG. 3. Optionally, a single elastic element extends continuously from the intersection of open face 38 with edge 61, rearward through edges 61 and 69, through cross edge 51, then back toward the front at edge 71 and edge 59, terminating at the intersection of open face 38 with edge 59. Modifying the edges 68, 70, and lower edge of 50 at the butt pocket is optional, because the butt pocket is constructed of a stiff ballistic fabric that is only minimally contractible, at best. Therefore, the elastic modifications may omit the butt pocket edges, and in FIG. 3 the optional butt pocket edges are given the indicated renumbering but no zig zag indication of an elastic member is shown. The choice of whether to modify the cross edge and side edges of the butt pocket passage may be a matter of whether a single elastic member is to be applied or whether separate lengths of elastic cord are to be applied to each of the two sides of the slit.

The lower edges 58, 60 of the side panels, as well as any other edges discussed, above, are modified to be elastic or at least contractible by the placement of elastic cord or similar stretch member into passages formed in such lower edges. A suitable way to create a contractible passageway for elastic cord at an edge is by folding the edge to form a lengthwise passageway for the elastic cord. Separate passageways or a continuous single passageway in a U-shaped loop may be formed. Then, the elastic or stretch cord can be pulled to be placed in tension, contracting the passages. As suggested by the zig zag pattern of contracted left and right edges 59 and 61 of FIGS. 2 and 3, elastic cord under tension in the edge passageways will lengthwise bunch together the fabric edges by elastic contraction. The elastic cord may be entirely contained in the passages and terminated at only two separate locations, such as where the two edge passages 59, 61 meet the rear end 38 of the barrel pocket 36. The cord may otherwise extend rearward through the passages 59, 61 of the central body 54 and the passages 69. 71 and 51 of the butt pocket 44, crossing between left and right edges at the cross passage 51. In this arrangement, the length of the active elastic cord is fixed and the amount of elastic tension is fixed. An advantage of the fully contained, fixed, non-adjustable cord is that there are no dangling cord ends to become snagged during use. Another option for contracting the edges 59, 61 is using the edge passages separately, each holding an individual cord. Non-stretchable draw cords are less desired because they present the problem of dangling cord ends outside the edge passages, which can lead to snagging when the rifle in being carried inside the cover or when the cover 10 is being applied to or removed from the rifle.

With reference to FIGS. 1, 2, and 3, the cover 10 is particularly adapted to avoid snagging when used with a rifle equipped with a scope 14. The cover 10 defines a scope pocket 34 that extends above the top 56 of the left and right side panels 54, 64 of the cover 10. The scope pocket may be formed by upwardly extending portions of a single panel of sheet material, preferably a fabric panel that also forms the sides of the central body 54. As an integral part of the single sheet of fabric forming the central body, the scope pocket has no cut or sewn edge between the scope pocket and the central body. As the scope pocket is above the level or the top edge 56 of the central body, the top edge may be a sewn seam along the top of the central body that is not at the scope pocket, but is present to the front and rear of the scope pocket. Thus, the top edge 56 results from the fabric panel being trimmed down at fore and aft segments at opposite ends of the scope pocket. Adding an elastic lower border to the scope pocket requires a different technique than described for adding the elastic edges 59, 61 to the side panels of the central body.

A key feature of the scope pocket 34 is its relatively major longitudinal dimension compared to the longitudinal distance between the barrel pocket 36 and the butt pocket 44. This major dimension is significantly longer that known or anticipated length of a rifle scope. The front end of the scope pocket may extend forwardly to the anticipated position of about a midpoint in the length of a forestock 20 carried in the cover 10. The back end of the scope pocket may extend to the anticipated position of about one quarter of the length of a stock 28 carried in the cover 10. Dimensionally, on a central body 54, the scope pocket could extend over the entire length of the central body 54, but a somewhat shorter scope pocket is desired to enable the scope pocket to assist in controlling excess fabric in the central body 54.

The length and position of the scope pocket on the central body 54 is determined by the length and position of the base or interface between the scope pocket and the central body. The scope pocket has a peripheral base defined by a pathway 72 that is elastic or capable of carrying or containing an elastic element that can be drawn to contract or cinch the shape of the pathway 72. The length of the scope pocket can be compared to the length of the central body 54. One comparison can evaluate the relative lengths with both elements measured when non-contracted. A typical non-contracted, roughly centrally positioned along the length of the central body 54, might be about forty inches. Terms such as "approximately" or "roughly" allow a deviation in central positioning of several inches either way, or about ten percent of central body length either way. The corresponding non-contracted length of the scope pocket might be about twenty-eight inches, which is seventy percent of the forty inch length of the central body 54. It has been found that a scope pocket will provide satisfactory gathering of loose fabric in the central body over a range of comparative length percentages. A satisfactory scope pocket of fifty percent of the central body length, centralized so that the fore and aft ends of the path 72 each cover about twenty-five percent of the body length, is pulling extra fabric from a position in the center of half the length of the central body 54. At sixty percent length, the fore and aft ends of path 72 each draw from about an end twenty percent of the body length plus about thirty percent of the length directly covered by the scope pocket. Thus, a scope pocket length range from about fifty to seventy percent is desirable. Scope pocket length greater than seventy percent also is desirable, with percentage lengths ranging from eighty to ninety percent of central body length. The position of the scope pocket is preferred to be roughly in the center of the length of the central body, leaving roughly equal fore and aft lenths outside the opposite ends of the path 72. With the seventy percent length of the scope pocket, each outside end length is about six inches or fifteen percent of the forty inch length along the top 56. With the indicated roughly central longitudinal placement of the scope pocket and with relatively large longitudinal lengths of the scope pocket, the long scope pocket is capable of assisting in control of excess or loose fabric in the central body.

The peripheral base of the scope pocket on the central body is approximately at the level of top edge 56. The preferred elastic element is an elastic stretch cord 78, shown in FIG. 4, which has a central length contained in a fabric passageway that follows path 72 and has opposite end lengths that extend from the path 72 and enter a size adjuster 76. With reference to FIG. 3, the path 72 is located at the periphery of the lower edge of the scope pocket. The elastic cord can be pulled and stretched by its end lengths to cinch the passageway on path 72, thereby drawing-in the peripheral path 72. This drawing-in of path 72 is effective to draw-up and draw together loose fabric in the central body 54. In the laid-open view of FIG. 3, the shape of the path 72 at the lower periphery of the scope pocket is shown to be similar to an oval, centered on top edge 56. The elastic contracting element following path 72 might be an elastic stretch cord or another similarly functional element. The path 72 is located in an approximately symmetrical position to the line of top edge 56.

To demonstrate the effectiveness of contracting the path 72, measurements were taken along the line of edge 56 when the elastic of path 72 was partially contracted. The scope pocket had contracted length of eighteen inches, reduced from the twenty-eight inch measurement for the non-contracted pocket length. This reduction in length shows that the overall contracted length of the central body 54 was reduced to thirty inches. With this partial contraction, the contracted length of the scope pocket was reduced to only sixty percent of the remaining contracted length of the central body 54 at contracted top edge 56. Fore and aft portions of the top edge 56 remained non-contracted with the previously determined lengths of about six inches each, which became twenty percent of the thirty inch length for each.

The measured contraction of elastic path 72 was only a preliminary contraction, such as might be made prior to entering a rifle into the cover 10. After a rifle and scope are in the cover, further contraction could be made to more snugly fit the scope pocket to the size and position of the rifle scope. With the rifle and scope present in the cover, reductions in the length of the scope pocket are less available or unavailable, but the peripheral path 72 can be cinched tighter by drawing the sides of the path 72 closer to the scope, which still further pulls loose or excess fabric from the central body 54. This further contraction is important because it draws central body into a snug fit around the rifle and scope. The snug fit equates to a snagless fit. Snagging otherwise can result from loose or excess fabric in the central body 54. FIG. 2 serves as an example of a properly drawn-together cover 10, which is best understood by comparison of the drawn-together cover 10 in FIG. 2 with the large quantity of excess fabric in cover 10 in FIG. 1.

The contracted fabric of the peripheral path 72 around the scope pocket is illustrated as a zig zag shape of the path 72 in FIGS. 2 and 3. The path 72 defines a periphery around the scope pocket as best shown in FIGS. 2 and 3 to be a surrounding or peripheral structure around the base of the scope pocket. A suitable form of the contractible path 72 defines a peripheral passage formed by applying a flexible, passage-forming ribbon over the intended path. The ribbon may be sewn at its longitudinal edges to the fabric of the path 72 along the side edges of the path 72. The passage-forming ribbon is applied to the inside of the fabric of the path 72, producing stitch lines 74 that are viewable from outside the central body as best shown in FIG. 1. The path 72 therefore has a passageway formed along its length between the sewn ribbon on the inside of cover fabric and the cover fabric itself forming the second side of the passage. With elastic stretch cord or other contracting means in place and active to contract the fabric of the peripheral path 72, the passageway is contracted into the zig zag shape of path 72 shown in FIGS. 2 and 3.

Figure 4:
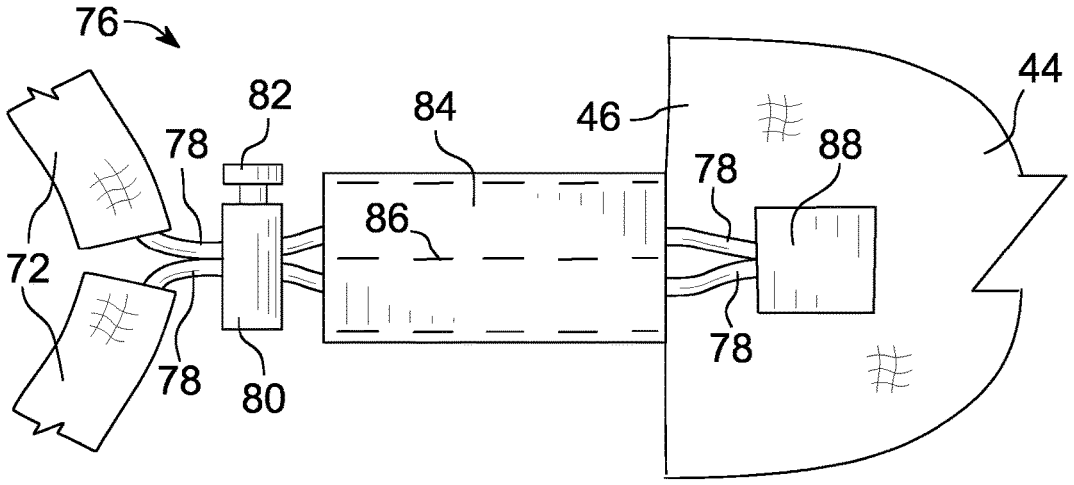
FIG. 4 is an enlarged detail view of the snagless size adjuster of FIG. 3.

In use, the contracted peripheral path 72 also draws in the fabric of any excess length of the scope pocket 34 to properly accommodate a rifle scope at any point in the length of the scope pocket. As suggested in FIG. 2, the contraction of the peripheral path locates the position of the rifle scope and draws the contractible path around the base of the rifle scope. Drawing in the peripheral passageway is important for eliminating loose fabric that otherwise might snag, which can result from excess fabric in the cover. The user can pre-adjust the scope pocket before setting out on field usage. This can be done by applying the cover of the intended rifle and adjusting a user-adjustable contraction element operating in the peripheral passageway around the base of the scope pocket. FIG. 3 shows the operating element 76 at the rear end of the scope pocket, and FIG. 4 shows an enlarged detail view of the operating element.

The operating element is a snagless size adjuster positioned at the interface of the scope pocket and the central body for conforming the size and position of the scope pocket, in use, to the size and position of a scope on a rifle contained in the cover. As best shown in FIG. 4, opposite end portions of a stretch draw cord 78 exit the contracted pathway 72 from the opposite two ends of pathway 72 at the aft end of the oval configuration of the pathway 72. The two cord portions 78 can be handled together. A cord lock 80 is located near the outlet ends of the pathway and fixed in place to the central body 54 approximately at top seam 56. The two cord portions are passed through the cord lock 80, which has both open and locked positions, controlled by movement of a spring-loaded plunger. The plunger head 82 depresses the plunger to open the lock and allow free passage of the cord, such as to permit the cord portions 78 to be drawn further out of the two ends of passage 72. The plunger head 82 is released to close the lock under spring force, locking the position of the cord by pinching the cord within the cord lock and thereby fixing the drawn length of the cord.

A snagless feature of the snagless size adjuster isolates the location of the cord to remain at the top of the central body 54, such as along top edge 56, which is outside the paths of entry and exit movement for the rifle. Likewise, the ends of the cord are located where they cannot exit the central body, such as to dangle from the cover 10. At the same time, the snagless feature does not significantly interfere with applying tension or releasing tension at pathway 72 at the periphery of the scope pocket. To achieve this performance, and to prevent the cord end lengths from sagging, a support panel 84 is positioned behind the cord lock and is attached to the central body at the top seam 56. The support panel is formed of two layers of fabric joined at longitudinal side edges. At a middle line between the side edges, a center divider 86 separates the support panel 84 into two longitudinal support passages. The support panel may have a length of about four inches and a width of about two inches, and each support passage may have a width of about one inch. The two cord ends are threaded through separate support passages on the opposite sides of the central divider 86. The two-layer support panel is attached by sewing to the inner top of the central body, with the rear end of the support panel at or near the open front 46 of a butt pocket. The two cord lengths extend from the rear end of the support panel and their terminal ends are then combined into a single pull tab and tension stop 88. Due to the placement of the support panel at butt pocket open edge 46, the pull tab 88 tends to stay in the butt pocket, atop the rifle stock 28. This placement eliminates the snagging hazard of dangling cords. Because the two cord ends are separated by the central divider 86 in the support panel and then combined in the pull tab 88, the cord ends cannot be inadvertently pulled free of the support panel, where they otherwise might dangle from open slit 66.

The cord 78 used at peripheral path 72 of the scope pocket can be an elastic stretch cord, which is preferred due to its inherent ability to combine two technologies: drawing and stretching. The elasticity provides a tension reserve and will maintain tension even with minor loosening. The cord at path 72 is preferred to be sewn into path 72, forming a single loop with essentially a single point of exit as suggested by FIGS. 3 and 4, so that the cord ends can be handled in a single cord lock 80.

To ensure high durability of cover 10, different fabrics are employed at different portions of the cover. The barrel pocket and the butt pocket are constructed of extremely wear resistant, durable fabric. A preferred fabric for this application is Cordura brand ballistic fabric formed of nylon 6, 6 filament yarns in a 2×2 basket weave. This fabric has high tenacity and greater than 420 denier. The central body 54 is constructed of a light weight, flexible fabric that responds well to shaping by elastic cords at the bottom edges of side panels 62, 64. The chosen fabric also should re-shape easily when drawn by elastic cord in a contracting loop at the periphery of the open bottom of the scope pocket. This latter feature is important for eliminating excess loose fabric that otherwise may lead to snagging. A thin, breathable, polyester fabric is suitable for the central body 54. A preferred fabric has an inside coating of a breathable, waterproof thermoplastic polyurethane (TPU) coating. Breathable fabric is extremely important for a gun case or cover to avoid storing the gun over a long term with water trapped in the case. The fabric also has durable water repellent (DWR) exterior. By employing a lightweight fabric for the central body of the cover, the entire cover can be self-stored in the butt pocket. Thus, overall, the rifle cover 10 solves many problems in the art.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The invention claimed is:

1. A cover for a long firearm, providing snagless retention, comprising:

a longitudinally elongated central body formed of flexible sheet material forming two opposite side panels defining between them a firearm reception space and forming an open bottom permitting reception of a firearm from below into said firearm reception space, when presented;

a scope pocket connected to a top edge of said central body and having an open scope pocket bottom communicating with said firearm reception space for reception of a scope on a presented firearm carrying such scope;

a peripheral path defining the edge of said open scope pocket bottom, thereby defining the shape and location of the open scope pocket bottom;

an elongated, stretchable elastic cord having a central length and two opposite end cord lengths, with said central cord length connected to said peripheral path and imparting elastic qualities to the peripheral path, said elastic qualities applying a selected degree of tension to the peripheral path according to stretch applied to the central cord length, and said end cord lengths exiting from the peripheral path at a point in near proximity to one another;

a cord locking element receiving the end cord lengths exiting the peripheral path and selectively locking the end cord lengths to preserve an applied degree of tension of the central cord length;

an elongated support panel defining elongated support passage receiving and supporting the end lengths from the end cord locking element;

a unifying tab receiving and uniting the end cord lengths from said support panel, preventing extraction of the end cord lengths from the support panel, and serving as a sag preventer for maintaining the end cord lengths from dangling below the cover; and wherein, the cord locking element and the support panel are attached to the central body near the top edge thereof to further support the end cord lengths from dangling from the cover.

2. The cover for a long firearm of claim 1, wherein:

said scope pocket is of a non-contracted length of at least fifty percent of the length of said central body.

3. The cover for a long firearm of claim 1, wherein:

said scope pocket is of a non-contracted length of at least sixty percent of the length of said central body.

4. The cover for a long firearm of claim 1, wherein:

said scope pocket is of a non-contracted length of approximately seventy percent of the length of said central body.

5. The cover for a long firearm of claim 1, wherein:

said scope pocket is of a non-contracted length less than the length of said central body; and the scope pocket is approximately longitudinally centered with respect to the longitudinal length of said central body.

6. The cover for a long firearm of claim 1, further comprising:

a barrel pocket attached to said central body at said longitudinal front end and having an open back end communicating with said firearm reception space;

wherein said barrel pocket has a front muzzle-receiving end and is shaped in a flare from the muzzle-receiving end to said open back end.

7. The cover for a long firearm of claim 1, further comprising:

a barrel pocket attached to said central body at said longitudinal front end and having an open back end communicating with said firearm reception space;

wherein said barrel pocket has a front-to-rear flared contour with a front muzzle-receiving end of a diameter of about 1.25 inches and said open back end is of about two inches.

8. The cover for a long firearm of claim 1, further comprising:

a butt pocket attached to said central body at said longitudinal rear end, having an open front end communicating with said firearm reception space, having an open bottom wall, having a rear wall with a lower end configured as a hook wall, and having a finger loop connected to the bottom of said hook wall for pulling back the hook wall to aid in entering a firearm butt into the butt pocket from below the butt pocket, when so presented.

9. The cover for a long firearm of claim 1, wherein:

said elongated elastic element comprises an elastic stretch cord;

said peripheral path defined proximate to said open bottom of said scope pocket comprises an elongated passageway;

said elastic stretch cord comprises a central section within said elongated passageway and stretchable opposite end lengths that extend outside the elongated passageway for applying tension to said central section to cinch the elongated passageway; and further comprising a cord lock receiving said opposite end lengths to lock the end lengths at a selected tension in the elongated passageway.

10. The cover for a long firearm of claim 1, wherein:

said central body is formed of breathable material;

the interior face of said breathable material is a breathable and waterproof coating of thermoplastic polyurethane; and the exterior face of the breathable material has a durable water repellant coating.

* * * * *